United States Patent [19]

Gambetti

[11] Patent Number: 4,574,565

[45] Date of Patent: Mar. 11, 1986

[54] METHOD AND MACHINE FOR PACKING CONTINUOUSLY MOVING ARTICLES WITH A STRIP OF HEAT-SHRINKABLE MATERIAL

[76] Inventor: Mario Gambetti, Via Rugginenta 485, 40014 Crevalcore (Bologna), Italy

[21] Appl. No.: 579,702

[22] Filed: Feb. 13, 1984

[30] Foreign Application Priority Data

Feb. 23, 1983 [IT] Italy ..... 3349 A/83

[51] Int. Cl.[4] ..... B65B 11/20; B65B 41/02; B65B 53/02

[52] U.S. Cl. ..... 53/442; 53/228; 53/389; 53/466; 53/557

[58] Field of Search ..... 53/228, 229, 230, 389, 53/557, 586, 397, 399, 442, 466

[56] References Cited

U.S. PATENT DOCUMENTS

| | | | |
|---|---|---|---|
| 3,075,325 | 1/1963 | Liedtke | 53/228 X |
| 3,267,642 | 8/1966 | Broadbert | 53/228 |
| 3,277,630 | 10/1966 | Youngman et al. | 53/228 X |
| 3,385,026 | 5/1968 | Schmermund | 53/228 |
| 3,577,866 | 5/1971 | Ehrenfried et al. | 53/557 |
| 3,618,740 | 11/1971 | Taverna | 53/229 X |
| 3,791,100 | 2/1974 | Monaghan | 53/557 X |

FOREIGN PATENT DOCUMENTS

| | | | |
|---|---|---|---|
| 7811232 | 5/1979 | Netherlands | 53/228 |

*Primary Examiner*—Robert L. Spruill
*Assistant Examiner*—Michael D. Folkerts
*Attorney, Agent, or Firm*—Karl F. Ross; Herbert Dubno

[57] ABSTRACT

A machine for packing articles supplied in a uniformly spaced manner by means of a continuously moving conveyor with a web which is progressively cut from a roll of heat-shrinkable material and projects from two lateral faces of the articles and brought in sequence by suction feed means along the respective longitudinal edges across the feed path between individual successive articles so as to be folded over the front, upper, lower and rear faces of a corresponding article with a trailing end portion extending beyond the respective lower face. The conveyor comprises two adjacent conveyor belt sections with the web feeder means supported in the area of the zone lying between the two adjacent conveyor belt sections. The adjacent zones of the two belts are wound on at least one pair of corresponding return rollers supported by a carriage which may be moved in an alternating manner parallel to the direction of transport and the feeder means may be moved in an alternating manner vertically and parallel with respect to the movement of the carriage.

13 Claims, 11 Drawing Figures

METHOD AND MACHINE FOR PACKING CONTINUOUSLY MOVING ARTICLES WITH A STRIP OF HEAT-SHRINKABLE MATERIAL

FIELD OF THE INVENTION

The present invention relates to a machine for packaging continuously moving articles with a strip of heat-shrinkable material.

BACKGROUND OF THE INVENTION

The technique which is at present used for packaging monobloc articles having a predominantly prismatic shape with a strip of heat-shrinkable material, or more frequently for packaging groups of individual articles formed for example by containers for products for general use and in particular for foodstuffs and the like in this monolithic prismatic form called hereafter, for simplicity, articles, comprises the use of so-called automatic machines having a discontinuous or continuous movement, whose construction may involve many methods of wrapping the heat-shrinkable material about the individual articles to be packaged.

In accordance with this packaging technique, it is conventional to wrap the article to be packaged in the direction of its movement with the strip of heat-shrinkable material such that this material projects from two opposite faces of this article, the whole then being passed through a tunnel oven in order to cause the said material to adhere by heat-shrinkage to the wrapped faces and to the said two opposite faces of the article by folding of the corresponding material over these latter faces.

Some of these known machines for the packaging of such individual articles which are supplied in a continuous sequence and are disposed in a uniformly spaced manner either discontinuously or continuously, use two strips of this heat-shrinkable material which, at a so-called sealing station, are bought rhythmically from above and from below between two successive articles where they are connected in a transverse manner by sealing and then cut so as to progressively form the closure or seal of a previous article and the junction of the strips for wrapping of the subsequent article. The articles wrapped in this way are then passed into the tunnel oven in order to cause the material to adhere to the wrapped faces by heat-shrinkage and to the two opposite faces of the respective article by folding of the corresponding projecting material over these last two faces (see for example U.S. Pat. No. 3,869,844 and 3,927,507).

Other known machines designed for the packaging of these articles which are caused to move continuously with a uniform spacing involve the use of a single strip of this heat-shrinkable material.

One of these latter known machines involves the supply of this strip parallel to the direction of movement of the articles which are uniformly longitudinally spaced, gradually folding it as it is supplied into a tubular shape with its respective longitudinal edges superimposed on the articles being supplied and joining these superimposed edges by heat sealing. The articles which are wrapped or enveloped in this way in the tubular shape of the strip are then caused to pass, while continuing with their continuous movement, via a first station or a first tunnel oven for a first heat-shrinkage of the material wrapped around the articles, and then, on discharge from this first station, via a second station in which the tubular shaped strip is cut between two successive articles so that material projects from the front and rear faces of two successive articles, and finally via a third station or second tunnel oven which completes the adhesion of the material by heat-shrinkage on the wrapped faces and on the front and rear faces of the article by folding of the corresponding material over these latter faces (see British Pat. No. 1 382 842).

Another of these known machines which uses a single strip for the packaging of articles which are supplied with a continuous movement in a uniformly spaced manner involves, in contrast, supplying this strip from above, in order to extend it above these articles, such that it still projects from two opposite lateral faces and to bring it, by drawing it from the corresponding spool, downwardly in a looped shape until it may be pushed in the feed direction of the articles below the previous article where the looped portion is cut providing two ends or sections of wrapped material, which are respectively the rear end of the previous article and the front end of the article immediately behind. During the continuous movement of the articles, the sections associated with each article are superimposed on one another on the lower face or base of the said article and the articles wrapped in this way are passed in sequence, still in their continuous movement, through a tunnel oven in order to cause the wrapping material to adhere by heat-shrinkage, as is conventional, to the wrapped faces and to the two opposite faces of the article by means of folding of the corresponding material over these latter two faces (see British Pat. No. 1 355 571).

It is also known from the prior art relating to the field of packaging to provide a method of supplying sheets or elements of packaging material progressively cut from a strip wound on a supply spool across the path of the articles to be packaged with a continuous movement so as to fold them into the shape of a horizontal U over the front face and the upper and lower faces which are parallel and adjacent thereto of the article with the end portions of the arms of this U-shape extending beyond the rear face and then to fold these end portions over this latter face where they are joined and sealed in partial superimposition. The means provided for carrying out this packaging method are normally constituted by at least two pairs of opposite belt means having a closed movement designed to grip the longitudinal edges of these sheets in order to bring them across the path of movement of the objects to be packaged (see British Pat. No. 1 037 261 and U.S. Pat. No. 2,424,406), or by only two of these means having a closed movement disposed respectively at the longitudinal edges and designed to entrain them by suction.

The machines which utilise this latter method of folding the packaging material into a U-shape with the final folding and joining of the edges of the sheets by sealing at the rear face of the articles to be packaged require complicated devices both for the final folding and for the sealing as a result of which, in the case of machines for packaging articles with heat-shrinkable material which are already provided with a tunnel oven in order to cause the heat-shrinkable material to adhere to these articles by heat-shrinkage, which material is also therefore heat-sealable, it is preferred to adopt the method described above which involves, as mentioned, folding the heat-shrinkable material firstly around the front, upper, lower, and rear faces of the article and then to fold a trailing end portion with a partial superimposition, over the lower face of the article.

The attempt to eliminate these complicated devices for folding and sealing of portions of these sections on the rear face of the products using the heat source of the tunnel oven to provide for the joining and sealing of the superimposed portions of the sections of the packaging material on the lower face of the articles simultaneously with the operation carried out in the oven to cause the heat-shrinkable packaging material to adhere by heat-shrinkage to the product in order to provide a greater degree of flexibility, i.e. a greater production speed per unit of time, and lower costs for these machines for packaging using the heat-shrinkable material, has not in practice enabled the achievements of these objects as a result of the complexity of the mechanisms used for the folding and superimposition of the above-mentioned end portions of the sections of material on the said lower face of these articles (see for example the above-mentioned GB Pat. No. 1 355 571).

OBJECT OF THE INVENTION

The object of the present invention is therefore to provide a machine of the type using a single strip of heat-shrinkable material for the wrapping of a sequence of articles which are supplied with a continuous movement in a uniform spacing and which uses the method for the successive wrapping of these individual articles which involves causing the material required for the wrapping of these successive individual articles to periodically intercept each of these articles during their continuous conveyor movement, which is embodied in such a way as to considerably simplify the stages relating to the operation of superimposition of the sections of the corresponding wrapping material on the lower face or base of the article.

SUMMARY OF THE INVENTION

The present invention therefore relates to a machine for wrapping articles supplied with a uniform spacing by a continuously moving horizontal conveyor by means of sheets which are progressively detached from a strip of heat-shrinkable material and which project from the opposite lateral faces of these articles and which are brought by suction feed means along the respective longitudinal edges across the feed path between individual successive articles so that they may be folded over the front, lower and rear faces of a corresponding article with a trailing end portion extending beyond the respective lower face, which machine is characterized in that the conveyor belt comprises at least two successive adjacent conveyor belt sections, and in that the suction feed means are substantially provided in the zone lying between the two adjacent sections of conveyor belts, the adjacent zones of these two successive conveyor belt sections being wound on at least a corresponding pair of return rollers supported by a support carriage which may be moved in an alternating manner parallel to the direction of transport and the suction feed means being supported such that it may be moved in an alternating vertical and parallel manner with respect to the movement of the support carriage.

BRIEF DESCRIPTION OF THE DRAWING

Further characteristic features and advantages of the machine of the invention are shown in the following detailed description of a preferred, although non-limiting, practical embodiment which is given solely by way of example with reference to the attached drawings, in which:

FIGS. 2A and 2B are further partial front and lateral perspective views of the part of the machine on an enlarged scale, with certain components removed and others shown in cross-section.

SPECIFIC DESCRIPTION

Figure 1:
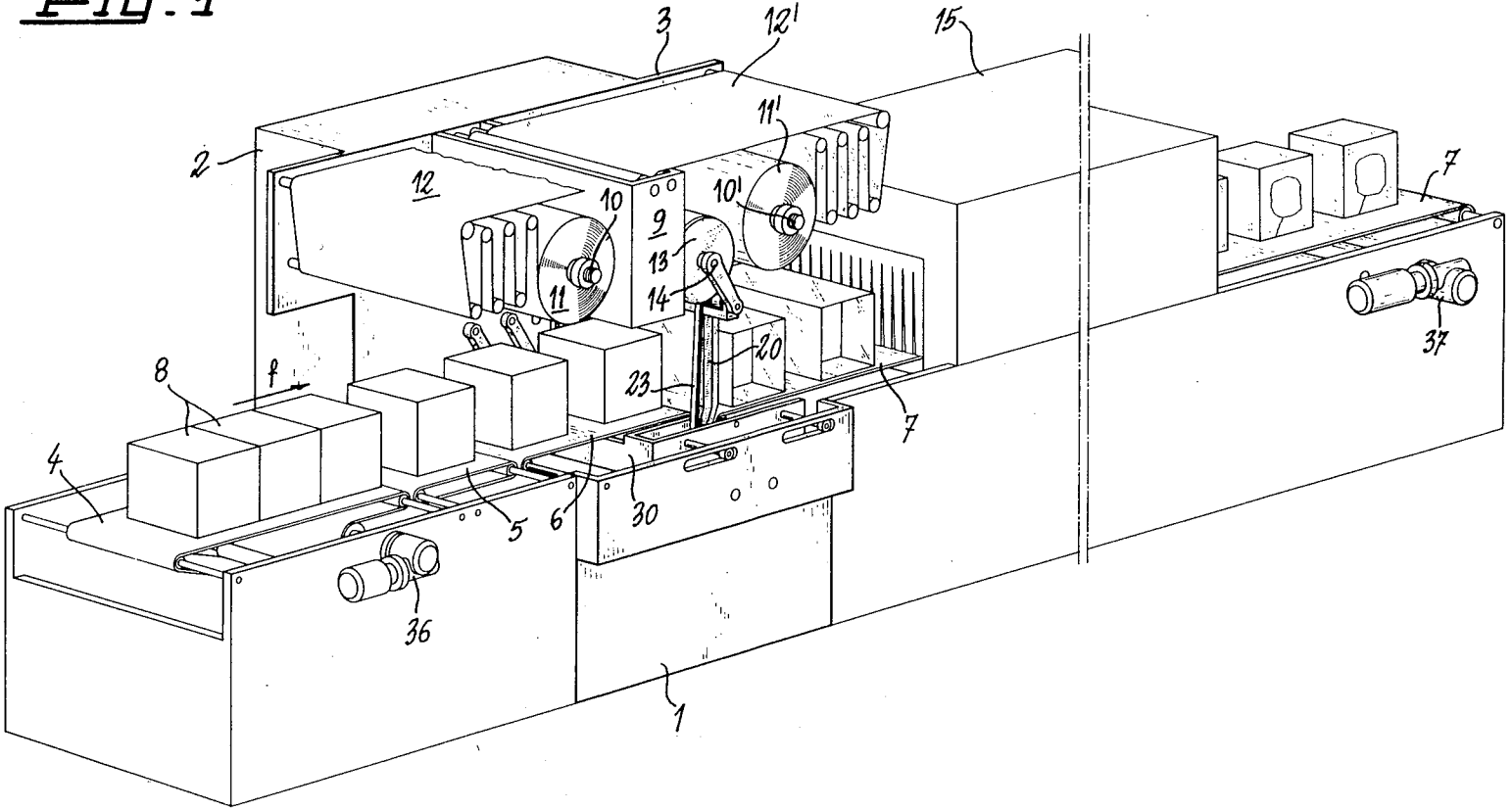
FIG. 1 is a partial front and lateral perspective view of machine according to the invention.

The machine illustrated for the wrapping of a sequence of articles moving continuously using sheets or elements obtained progressively from a roll of heat-shrinkable material essentially comprises a base bed 1 and a vertical housing 2 having a front support wall 3. The base 1 supports four conveyors which are horizontally coplanar, each of which is formed in a known manner by a corresponding conveyor belt wound as a closed loop around respective return rollers, only some of which are shown in the Figures. The conveyor belts are numbered moving from upstream to downstream, i.e. from left to right in FIGS. 1 and 2, by 4, 5, 6 and 7, those belts numbered 5, 6 and 7 having an identical speed, which is greater than the speed of the conveyor belt 4 which is further upstream and which is designed to space the articles 8 to be packed in a uniform manner as can be seen from FIG. 1. Above the downstream end zone of the conveyor belt 6, the front wall 3 supports in a projecting manner an arm 9 constituted by two vertical plates which are connected together at their free ends over their entire respective height so as to form a boxshaped body which is open at the top and the bottom, and the opposite portions of this arm 9 support a corresponding shaft 10, 10' which supports a respective spool 11, 11' of heat-shrinkable packaging material in strip or web form 12, 12' and a corresponding plurality of known return rollers (not numbered) for the strips 12, 12' which may be used one after the other in the conventional way by means of or without a mechanised strip changer. Between the arm 9 and the spool 11' there is disposed a known suction roller 13 keyed on a shaft 14 which is supported in a projecting manner by the vertical front and rear walls of the housing 2 and driven in a way which will be described below (see also FIG. 2). Within the arm 9 there are disposed two pairs of idler rollers for the return in a vertical downward direction of one or the other strip 12, 12' when used. Downstream of the spool 11' and straddling the conveyor belt 7 in an intermediate zone thereof there is provided the conventional tunnel oven 15 used in these machines.

At the sides of the roller head 13, the shaft 14 has mounted on it, in a freely rotatable manner, the end of a corresponding connecting rod 16, only the front one of which is shown in the Figures, whose other end supports a horizontal shaft 17 which extends below the roller 13 in a parallel manner. Around this shaft 17 and the jacket of the roller 13 there is wound a plurality of belts having a circular section 18 for the transmission of the movement from the last to the first in the manner which will be described below. In the vicinity of the opposite ends of this shaft 17 the shaft supports in a freely rotatable manner the free ends of the arms of a U-shaped horizontal element 19 which extends parallel to the shaft and the roller 13. Two tubular elements 20 having prismatic cross-sections which extend downwardly to the opposite longitudinal edges of the conveyor belt 6 extend from this element 19. These tubular elements 20 whose downstream facing walls in the direction of the arrow f are perforated, are shaped at their respective lower ends as forks in which there is disposed a corresponding roll 21 mounted freely on a corresponding pin 22. The tubular element 20 adjacent the wall 3, is provided with a projection 20' which is also box-shaped and is connected in a known manner with a suction source (not shown), to which the suction roller 13 is also connected. Around the above-mentioned idler rolls 21 there are wound corresponding perforated belts 23 which is also wound around the shaft 17 so that they adhere by sliding friction, as will be described below, to the perforated surfaces of the tubular elements 20.

The belts adjacent the gap between the conveyors 6 and 7 are returned in a zig-zag manner in opposite directions by three rollers which are indicated respectively by 24, 25, 26 and 27, 28, 29. The rollers 26 and 29 are supported by the base 1 of the machine, while the rollers 24, 25 and 27, 28 are supported by a carriage 30 having a box shape which is slidably supported on the base by means of two sets of projections 31 and 32 provided on its opposite sides and slidably engaging sections of a rod 33 and a respective eyelet 34 by means of a corresponding idler roller 35 supported by the said base 1. The end conveyor belts 4 and 7 are driven at the speed ratio described above by independent gear reduction units 36 and 37, whereas the conveyor belt 6 is driven by the roller 26 keyed on the output shaft 38 of a reduction gear 39 having two output shafts and which is driven by an electric motor 40. The conveyor belt 5 derives its movement from the shaft 38 in a known manner (not shown). On the second output shaft 41 of the reduction gear 39 there is keyed a toothed transmission pulley or sprocket 42 around which there is wound a toothed transmission belt 43 which is also wound about a toothed pulley or sprocket 44 keyed on the drive shaft 14 of the roller 13 which also drives the perforated belts 23 via the belts 18 and the shaft 17.

The toothed transmission belt 43 also engages with a toothed pulley or sprocket 45 keyed on a shaft 46 supported horizontally within the housing 2 by its opposite vertical front and rear walls. Within this housing 2, the walls also support a further horizontal shaft 47. On the shaft 46 there are keyed two discs 48 and 49 which have a cam groove 48' and 49' on one of their faces. A cam follower roller is engaged in the cam groove 48', which roller is supported freely at an intermediate point by a lever 50 which is in turn supported at one of its ends by the shaft 47 so that it may oscillate and at whose other end there is articulated one end of an adjustable tie-rod 51 whose other end is articulated on one end of a lever 52 whose other end is fixed to a shaft 53 supported in an oscillating manner by the front and rear walls within the housing 2. At the end of the shaft 53, projecting from the housing 2, there is fixed the end of a lever 54 at whose other end there is articulated the end of a rod 55 having its other end fixed to the projection 20' of the rear tubular element 20. On this projection 20' there is articulated one end of a lever 56 whose other end is articulated on the front wall 3 of the housing 2 and forms with the lever 54 an articulated parallelogram. In this way the suction unit formed by the tubular suction elements 20 and the respective perforated belts 23 is driven with an oscillating movement about the shaft 14 for the function which will be described below. In the cam groove 49' there is, in contrast, engaged a cam follower roller which is freely supported at an intermediate point by a lever 57 which is in turn supported at one end by the shaft 47 so that it may also oscillate and has articulated on its other end an adjustable tie-rod 58 whose other end is articulated on one of the lateral projections 31 of the carriage 30 so that the latter may be driven with an alternating movement for the function which will be described below.

Figure 2A:
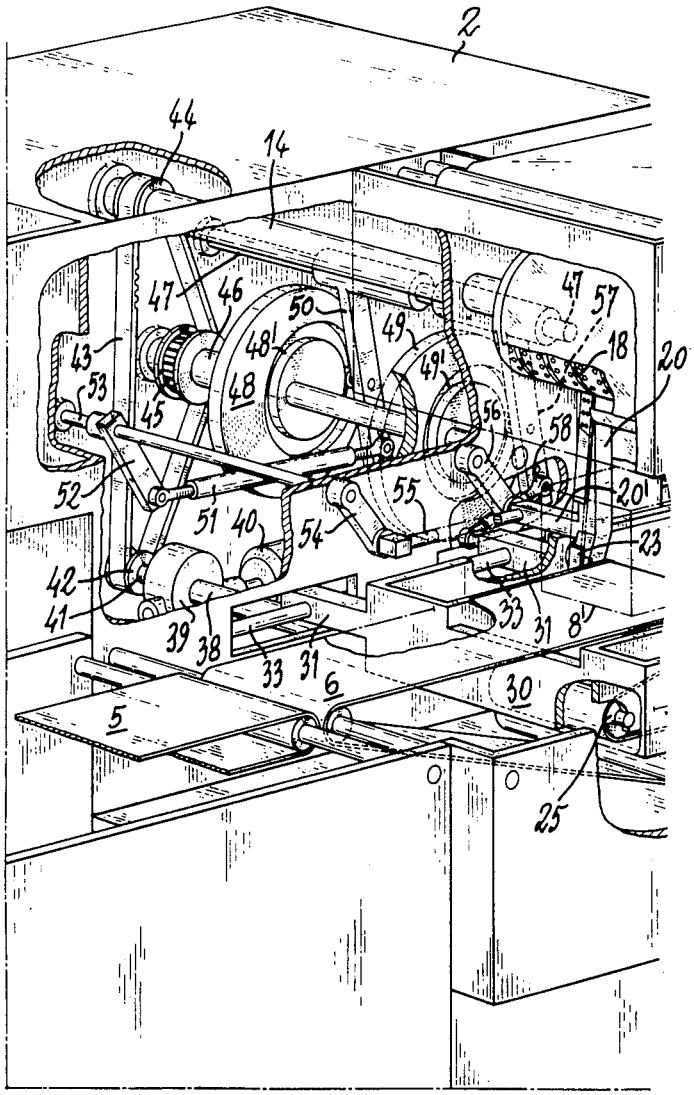
Figure 28:
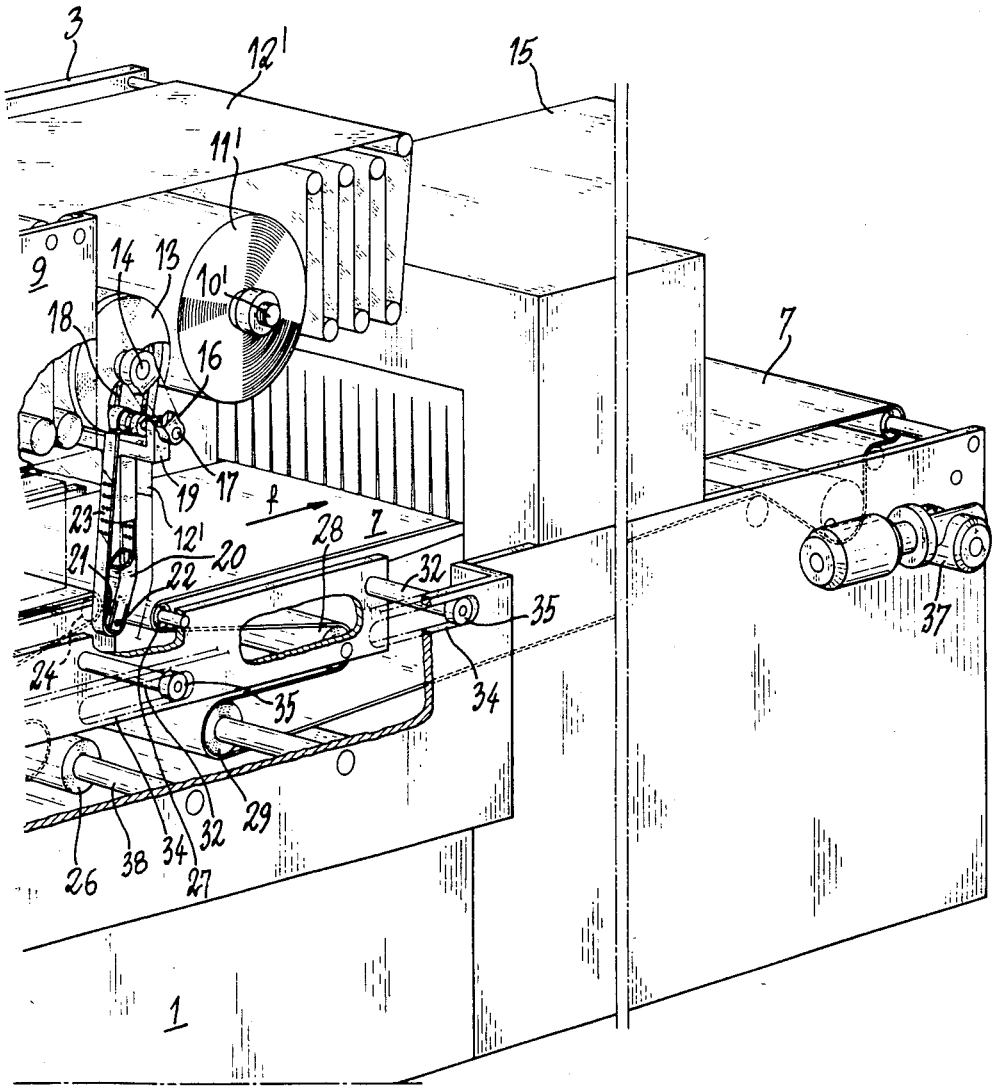
Figure 3:
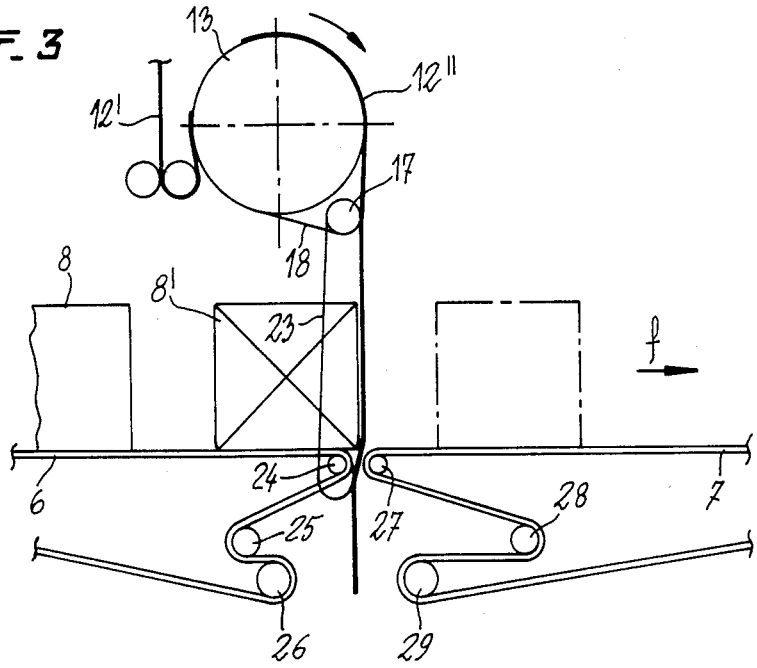
FIGS. 3 to 10 show certain operational stages of the machine in diagrammatic form.
Figure 4:
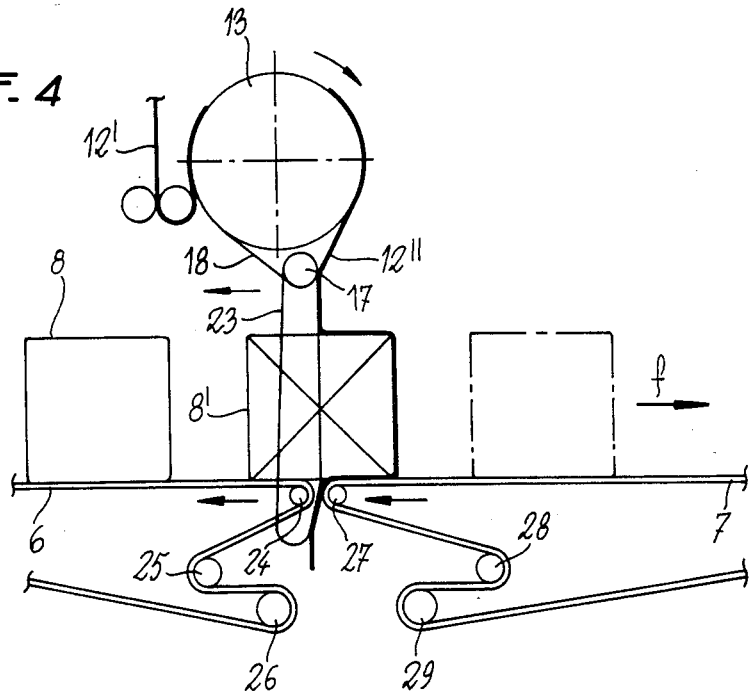

The machine described above operates as follows:

When the machine is on, the conveyor belts 4, 5, 6 and 7 transport, via the kinematic mechanisms described above and with a continuous movement in the direction of the arrow f, the articles 8, so as to uniformly space them as shown in FIG. 1. One of the two strips of heat-shrinkable material, whose transverse dimension is greater than the transverse dimension of the articles, in order to wrap the latter in the displacement direction of the arrow f about the corresponding four faces and projecting from the lateral opposite end faces, for example the strip 12' is drawn, as shown in FIGS. 1 and 2, from the corresponding spool 11' by way of the suction roller 13 in a downward direction by the perforated suction belts 23 which continue, in turn, to draw it further downwards through the gap between sections 6 and 7 between two successive articles on the feed path so that it comes into contact with the article 8' arriving from upstream while in a known manner the said strip 12' is cut transversely into strips or sections 12" having the required length for this wrapping (see FIG. 3). While the article 8' is fed forward and passes progressively from the conveyor belt 6 to the conveyor belt 7, the sheet or section 12" is folded over the front face of the article 8' and subsequently over the upper and lower faces while the group formed by the tubular suction elements 20 and the perforated belts 23 is caused to oscillate by the kinematic mechanism described above leading to the cam disc 48, in a clockwise direction about the axle 14 of the suction roller 13 in a lowering upstream direction as can be seen from FIGS. 3 and 4.

Figure 5:
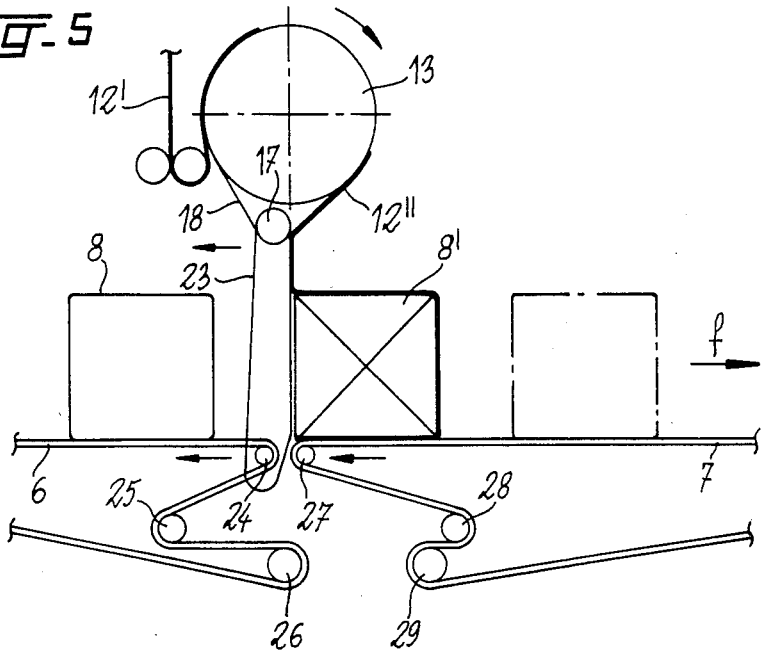
Figure 6:
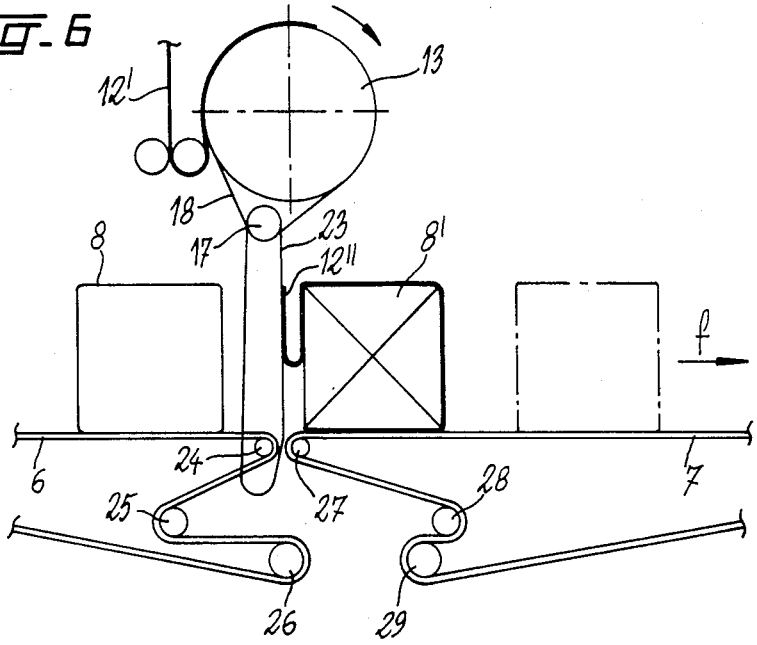
Figure 7:
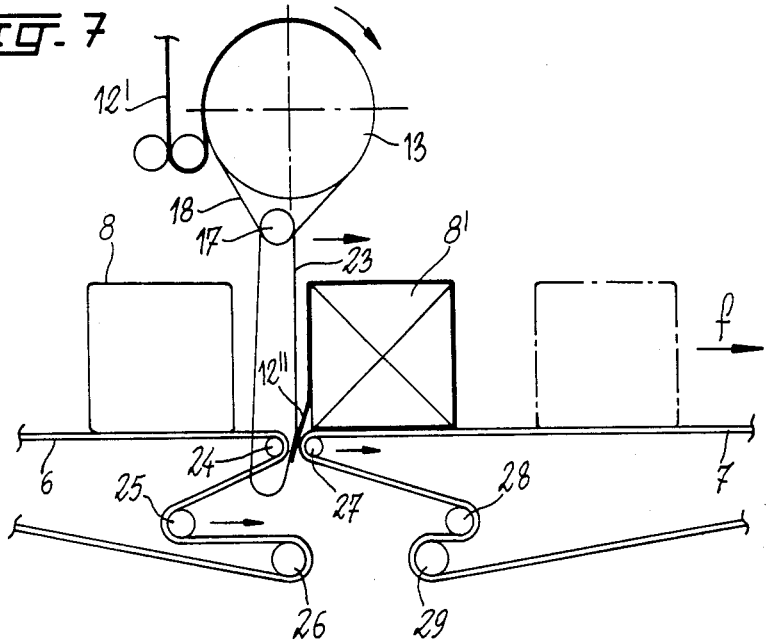
Figure 8:
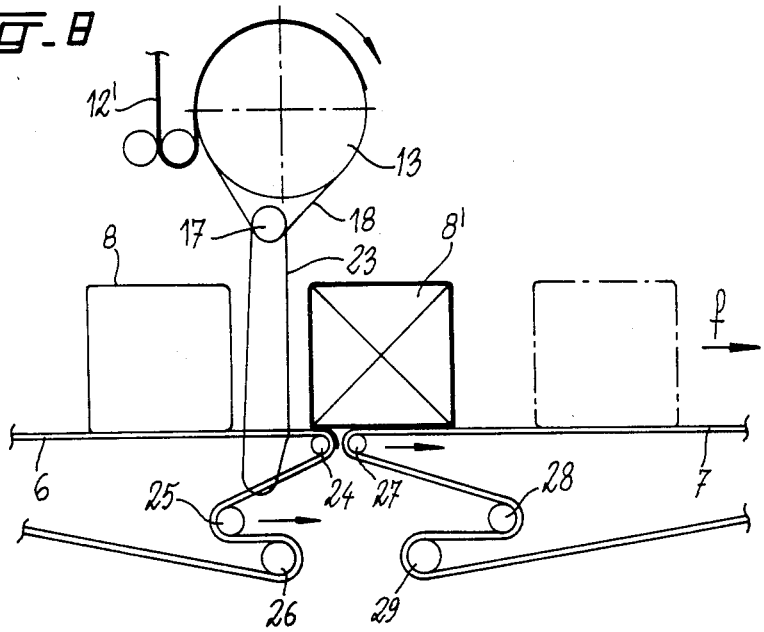
Figure 9:
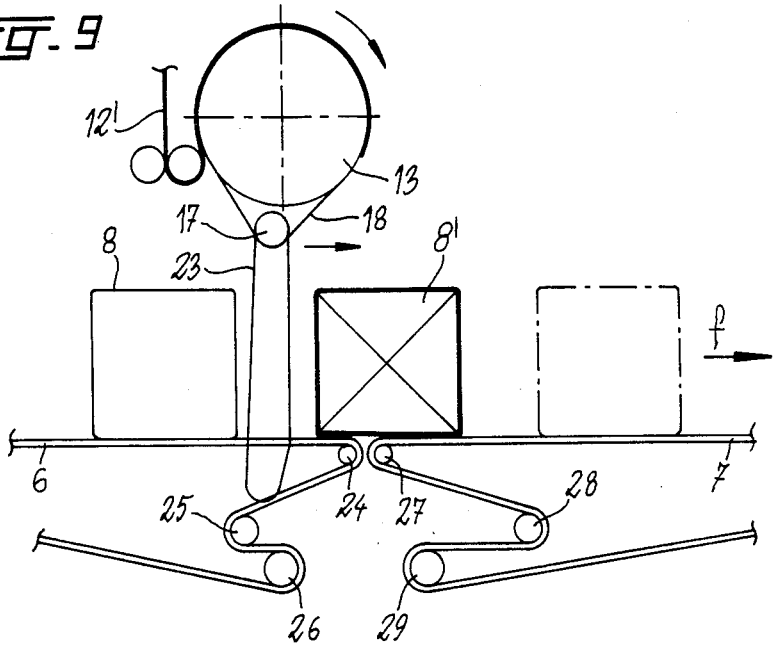
Figure 10:
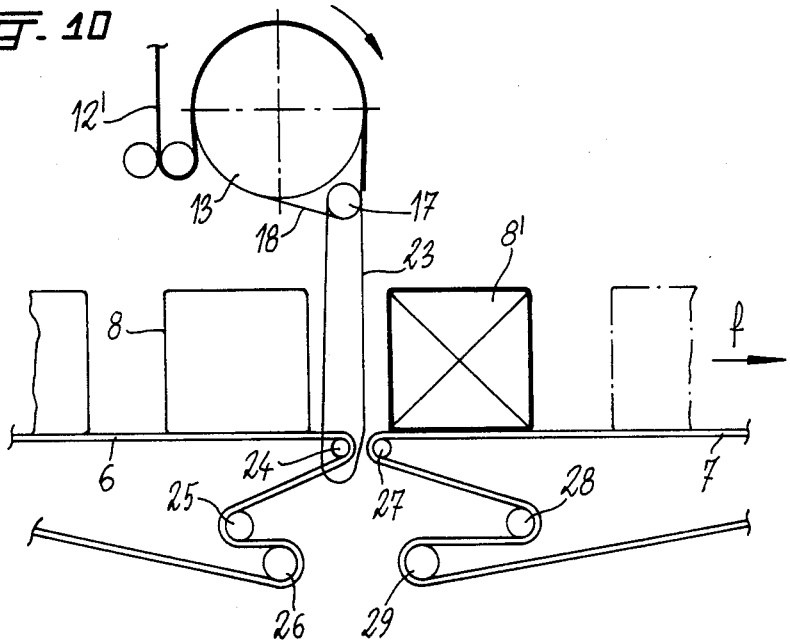

When the article which has its front, upper and lower faces wrapped is fully located on the conveyor belt 7 just past the gap, and while the suction group 20, 23 continues to oscillate, the belts 23 continue to draw the end portion of the strip 12" downwards along the rear face of article 8' (see FIGS. 5 and 6) and, by means of the kinematic mechanism described above which leads to the cam disc 49, the carriage 30 is caused to slide forwards so as to shorten and respectively lengthen in the direction of the arrow f the adjacent portions of the conveyor belts 6 and 7 with a higher speed than the conveyor speed, with folding of the trailing end portion of the strip 12" under the article 8' by the advance of conveyor 6 by roller 24 over the initial portion of the strip 12" which has previously been folded against the lower face of the article 8', while the suction group begins simultaneously to oscillate in a direction opposite to the previous direction, i.e. in a counter-clockwise direction (see FIGS. 7 and 8). FIG. 9 shows the stage in which the article 8' is completely wrapped around the front, upper, lower and rear faces, this stage following the stage shown in FIG. 8, while FIG. 10 shows all the parts involved in the abovementioned folding of the strip 12" around the article 8' positioned for the commencement of a new cycle as described above with reference to FIG. 3. The articles wrapped in this way are then supplied in sequence by the conveyor belt 7 to a tunnel oven 15 in order to cause the heat-shrinkable material to adhere by heat-shrinkage, as in conventional, to the wrapped faces and the projecting material, by folding over the two lateral opposite end faces is caused to adhere to these latter faces and on discharge onto the end portion of the conveyor belt 7 it has the form shown in FIG. 1.

It has been observed in practice that with a machine for packaging articles which are continuously moving with heatshrinkable material in strip form, as embodied in accordance with the invention, it is possible to make considerable savings and simultaneously reach high production speeds by carrying out all the above-mentioned objects.

The description of the continuous machine in question which is made with reference to the attached drawings is obviously given solely by way of example and it is therefore evident that it may include any modifications and varients suggested by practice and by its utilization or use in which a strip of material supplied with a continuous movement is progressively cut into a sequence of strips in order to be wrapped around articles with the respective end portions superimposed on the lower support face of the articles, which modifications and variants should be considered to lie within the scope of the following claims.

I claim:

1. A method of wrapping a box-shaped article comprising the steps of:

(a) advancing said article along a first conveyor in a travel direction to entrain a web of heat-shrinkable wrapping material spanned across a gap between an end of said first conveyor and an end of a second conveyor juxtaposed with said end of said first conveyor, whereby said web lies upon a leading face and upper and lower faces of said article while transferring said article to said second conveyor;

(b) while continuing to displace said article in said travel direction, shifting said ends jointly in an opposite direction thereto and carrying said material onto substantially the entire upper and lower faces of said article;

(c) while continuing to displace said article in said travel direction, feeding said web along a rear face of said article and following the motion of said article with the fed web;

(d) thereafter moving said ends relative to said article in said travel direction to overlap a trailing end of said web onto the web portion previously carried onto said lower face of said article; and (e) thereafter displacing said article into a tunnel oven whereby said material is heat-shrunk to adhere to the faces of said article.

2. The method defined in claim 1 wherein the position of said gap is adjusted by extending the length of one of said conveyors while simultaneously shortening the length of the other of said conveyors.

3. The method defined in claim 1 wherein said web is wider than said article whereby when said article is displaced into said tunnel oven the web material extending beyond the end faces of said article is caused to fold and adhere to said end faces by the heat-shrinkage of said material.

4. The method defined in claim 1 wherein successive discrete strips of said heat-shrinkable material are severed from a supply roll and fed between successive articles uniformly spaced along said first conveyor and advanced to said gap.

5. A machine for wrapping a box-shaped article comprising:

a continuously moving generally horizontal conveyor for advancing said article in a travel direction, said conveyor including a first upstream section spaced from a second downstream section and defining therewith a transverse gap;

means for adjusting the position of said gap along the conveyor path;

means for feeding a discrete web of heat-shrinkable material through said gap across the path of said conveyor whereby said web lies upon a leading face and upper and lower faces of said article while transferring said article from said first section to said second section of said conveyor;

means for adjusting the position of said feeding means both vertically and along the conveyor path whereby said feeding means and said gap are shifted jointly in a direction opposite to said travel direction for carrying said web onto substantially the entire upper and lower faces of said article, said feeding means retaining a trailing portion of said web and feeding same along a rear face of said article and through said gap to form a trailing end of said web extending beyond said lower face, whereby said gap is shifted relative to said article in said travel direction to overlap said trailing end onto the web portion previously carried into said lower face of said article; and a tunnel oven for receiving the wrapped article and in which said web is heat-shrunk to adhere to the faces of said article.

6. The machine defined to claim 5 wherein said first and second conveyor sections are each formed by an endless loop having a horizontal conveying portion and in which the means for adjusting the gap position includes means for extending the length of one of said horizontal portions while simultaneously shortening the length of the other of said horizontal portions.

7. The machine defined in claim 6 wherein said means for adjusting the length of said horizontal portions includes a plurality of rollers forming respective first and second groups around which the respective endless loops of said first and second conveyor sections pass, at least two end rollers from said first and second groups being mounted adjacent said gap in a movable carriage whereby movement of said carriage in said travel direction extends the horizontal portion of said first upstream section and simultaneously shortens the horizontal portion of said second downstream section, and movement of said carriage opposite to said travel direction extends the horizontal portion of said second downstream section and simultaneously shortens the horizontal portion of said first upstream section.

8. The machine defined in claim 7, further comprising a cam-operated mechanism for controlling the movement of said carrige whereby said carriage is shifted upstream or downstream at a speed exceeding that of the advancing speed of said conveyor.

9. The machine defined in claim 5, further comprising a suction roller rotatably mounted on an axis above and transverse to said conveyor and parallel thereto for advancing said web to said feeding means, and said means for adjusting the position of said feeding means is mounted for oscillation about said axis.

10. The machine defined in claim 9 wherein said feed means is formed by a pair of hollow suction arms supported substantially over said gap, each arm having a respective perforated side facing downstream, said arms flanking the longitudinal edges of said first conveyor section, a respective perforated belt wound on each arm in a closed loop and means being provided for displacing the respective perforated belts around said arms with a continuous movement for sliding contact with the perforated sides of said arms, whereby the suction established in said hollow arms acts through said perforated belts to engage said web.

11. A machine for wrapping articles supplied in sequence and uniformly spaced on a continuously moving horizontal conveyor in a travel direction by means of sheets progressively detached from a roll of heat-shrinkable material and which project beyond opposite lateral end faces of said articles, said sheets being positioned by suction take-up means across the path of travel between individual successive articles, whereby a respective sheet is folded over a leading face and upper and lower faces of a respective article, with a trailing end of said respective sheet extending beyond the lower face of said respective article, said conveyor comprising at least two successive sections of adjacent conveyor belts defining between them a transverse gap, said suction take-up means being provided substantially at said gap, the respective belts each being wound at said gap on a respective return roller supported on a common carriage which is reciprocatingly movable parallel to said travel direction for shifting said gap at a speed greater than the travel speed of said conveyor.

12. The machine defined in claim 11 wherein said suction take-up means is movably supported for reciprocation in vertical and parallel directions with respect to the movement of said support carriage.

13. The machine defined in claim 11 wherein the movement of said carriage is controlled by a cam-operated mechanism.

* * * * *